United States Patent [19]

Parry

[11] 4,248,392

[45] Feb. 3, 1981

[54] APPARATUS FOR APPLICATION OF PLASTICS STRETCH FILMS

[76] Inventor: John C. Parry, 6729 Brookmont Dr., Baltimore, Md. 21207

[21] Appl. No.: 104,847

[22] Filed: Dec. 18, 1979

[51] Int. Cl.[3] ..... B65H 17/44

[52] U.S. Cl. ..... 242/96; 242/99

[58] Field of Search ..... 242/68.6, 96, 99, 75.4, 242/156, 156.2

[56] References Cited

U.S. PATENT DOCUMENTS

| | | | |
|---|---|---|---|
| 521,245 | 6/1894 | Partridge | 242/99 |
| 2,917,249 | 12/1959 | MacLelland | 242/99 X |
| 3,198,175 | 8/1965 | Dean | 242/99 X |
| 4,179,081 | 12/1979 | Parry | 242/99 |

*Primary Examiner*—Edward J. McCarthy
*Attorney, Agent, or Firm*—Walter G. Finch

[57] ABSTRACT

The invention is an improved apparatus for the application of plastics stretch films to materials and items to be packaged and secured as a unit or packaged and secured to a shipping and transporting means. The apparatus consists of a pair of insertable adapters for the ends of a cylindrical core which holds a supply of plastic stretch films and a pair of tubular-like grip means for said insertable adapters. The grip means serves as a control means for the speed of paying out the plastics stretch film material, and as a means for applying tension on the film during the course of applying it to materials and items. The apparatus may be used for manual or machine application of film to materials. Brake shoe equivalents of the grip means may be used for machine applications.

12 Claims, 7 Drawing Figures

APPARATUS FOR APPLICATION OF PLASTICS STRETCH FILMS

BACKGROUND AND SUMMARY OF THE INVENTION

The invention relates to packaging and shipping systems and in particular to packaging of materials and items to be secured as a unit load or to be secured to a shipping and transporting means, such as a pallet or slip sheet. Specifically, it relates to such systems using plastics stretch film (a high cling film) as the binding and securing agent.

A need has existed for some time for a simple and economical means for applying plastics stretch film material. A copending application of the present invention, Ser. No. 914,801, filed June 12, 1978, now U.S. Pat. No. 4,179,081, entitled "System For Application of Plastics Stretch Films" solved part of the problem and provided a simple and economical means to do the work. However, several problems remained and the present invention, solves the remaining problems. The apparatus may be used for manual or machine application of the film.

In the prior art two methods are available for applying the plastics stretch film material to materials and units to be packaged or secured as hereinbefore described.

One method is to use a very expensive automatic machine to hold a supply of the plastics stretch film and to automatically wrap it around the unit of materials to be packaged; and to secure the unit of materials to a shipping or transporting means. Such machines require the attention of an operator and they do have their own limitations.

Another method is to use a commercial manually operated grabbing or holding device. However, this manually operated device is very expensive in comparison to the cost of the present invention. The commercial device is difficult to adjust to obtain the wide range of speeds and tensions that are required while manually wrapping the plastics stretch film to a unit load. The adjusting system on the commercial unit is such that it is difficult to "feel" the fine line between "full stop" and "just barely moving". As a result, many broken films are encountered during use of the commercial unit. The aforementioned copending application solved some of the problems. The present invention eliminates these other problems and is extremely simple to operate.

One of the devices in the prior art consists of a shaft means passing through the tubular core of the roll of plastics film material. The shaft has more or less "D" shaped hand grips on each end that are held by the operator and used to pull the plastics film around or over the unit or load being packaged or secured. When more tension is to be placed on the plastics film, one of the two hand grips is twisted to tighten the shaft movement through the core of the roll of plastics film. This tightening by twisting one of the hand grips does not provide a sensitive "feel" in the operator's hands and is the cause of the frequent breaking of the plastics film mentioned hereinbefore.

Another of the devices in the prior art consists of a shaft means passing through the aforementioned tubular core of the roll of plastics film material. The shaft also has more or less "D" shaped hand grips on each end as hereinbefore described, but the tension adjustment is provided by a brake-nut on the end of the shaft.

Changes in the need for more or for less tension requires the operator to use one hand to operate the brake-nut while holding the roll of plastics film with the other hand in one of the "D" shaped hand grips. This method of adjusting the tension is an awkward operation to perform. In addition, this method also causes frequent breaks of the plastics film. Other prior art methods apply friction to the edges of the cores, such as using a leather pad, a metal cone, and similar systems.

In the aforementioned copending application and in the present invention the control of the amount of tension is by the direct pressure or the squeeze of the operator's hands on the flexible tube-like devices around adapter extended ends of the core of the roll of plastics material. Two embodiments in the copending application and two embodiments in the present invention are provided for extending the core ends of the roll of the plastics material, however, the tension control means is the same in each case.

In the prior art the fixing of the device to a roll of plastics stretch film required considerable time and effort to insert a shaft through or to drive a toothed or spiked shaft into the ends of the core of the roll of plastics stretch film, and then add hand grips, holding or securing nuts, and other such mechanical operations. In the copending application, the preparation is primarily the slipping of two flexible hand grips on the ends of the core of the roll of plastics stretch film or on simple inserts in the core. Several problems still remain and in the present invention these problems are solved as hereinafter described.

One problem concerns the fusing together of the ends of the last wraps of the plastics film on the supply core by the heat of the friction of the braking unit rubbing against the exposed ends of the roll of plastics film as the roll turns while film is being applied. This usually occurs in connection with rolls of film on small diameter cores. Loss of film stock through fused ends usually amounts to 10 to 30 linear feet, a considerable wastage. Once fused, the film tears, rather than breaking loose. Heat sealing one end of the braking unit partially solves the problem.

The present invention eliminates this problem by the first embodiment provided. It provides an insertable adapter for the small diameter cores which moves the edges of the braking unit down below the external surface of the supply core. It thus avoids friction against the exposed edges of the film on the supply core and consequently eliminates frictional heat that fuses the ends of the film together.

The adapter utilizes a rubberized or rubber-like or friction generating material means to frictionally attach it to the inside diameter of the supply core.

The other problem is that with large diameter supply cores, the use of wedge-type adapters distorts the ends of supply cores which renders the cores unsatisfactory for reuse and often destroys the recycling possibility. In addition, the wedge-type adapter is often difficult to remove from the core.

The present invention eliminates this problem by the second embodiment which provides for an insertable adapter having a plurality of both internal and external nodes that have a flexibility to assist in making the insertion. The external nodes interfacing with the surface at the internal diameter of the supply core, and the internal nodes interfacing with the surface at the external diameter of the insertable adapter used for control.

The details of both of these embodiments of the present invention are described in the specification hereinafter.

It is, therefore, an object of the invention to provide an apparatus for applying plastics stretch film to a unit that is economical to manufacture and simple to operate.

It is another object of the invention to provide an apparatus for applying plastics stretch film to a unit that permits the operator to "feel" the movement and tension condition through the hands on the device of the system.

It is yet another object of the invention to provide an apparatus for applying plastics stretch film to a unit that consists of two simple flexible hand grips for control.

It is a further object of the invention to provide an apparatus for applying plastics stretch film to a unit that does not require the operator to remove the hands from the device to change the tension setting.

It is still another object of the invention to provide an apparatus for applying plastics stretch film to a unit that prevents fusing of the ends of the plastics stretch film on the supply core.

It is also an object of the invention to provide an apparatus for applying plastics stretch film to a unit that has a flexibility of adaptation to a range of supply cores which is easy to insert and reuse without damage to the supply core.

It is also another object of the invention to provide an apparatus for applying plastics stretch film to a unit either manually or mechanically.

Further objects and advantages of the invention will become apparent in the light of the following description of the preferred embodiments.

DESCRIPTION OF THE PREFERRED EMBODIMENTS

Figure 1:
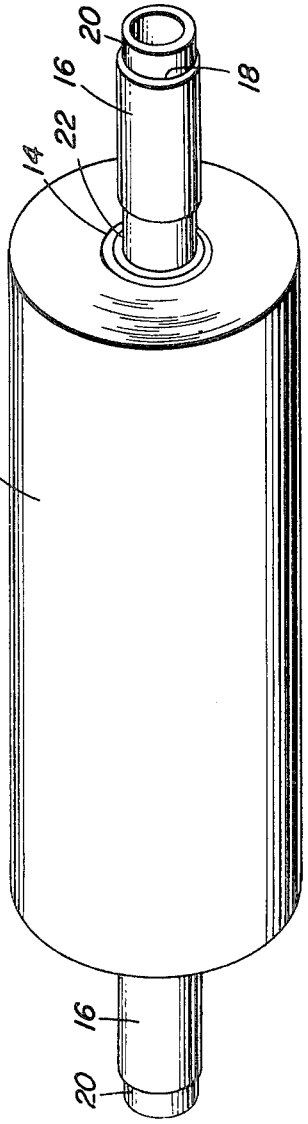
FIG. 1 is a pictorial view of a first embodiment of flexible hand grips on an insertable adapter with frictionable contact surfaces for connection to a core of plastics stretch film.
Figure 3:
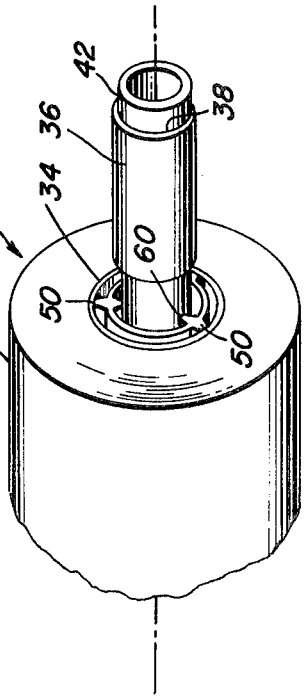
FIG. 3 is a pictorial view of a second embodiment of flexible hand grips on an insertable adapter with flexible nodes for connection to a core of a roll of plastics stretch film.
Figure 6:
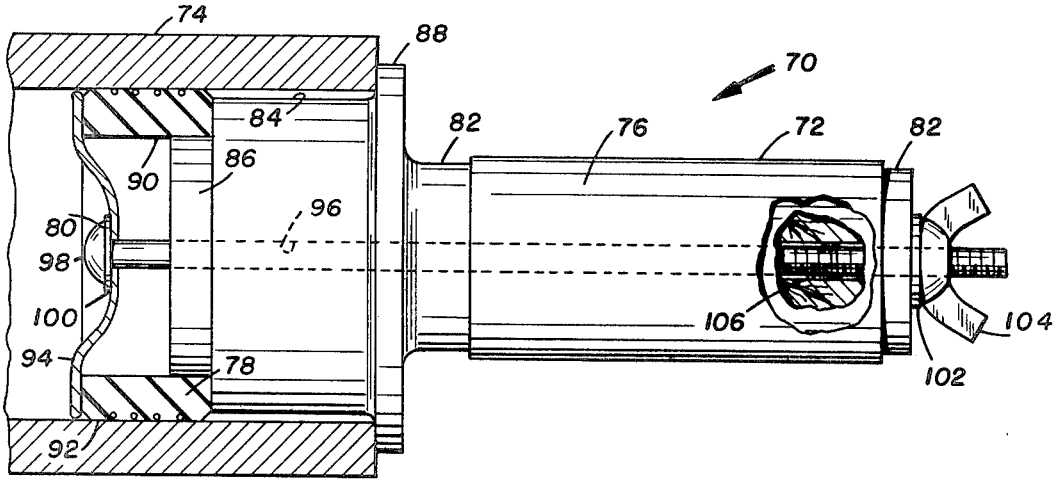
FIG. 6 is a cross sectional view of a third embodiment of an insertable adapter for connection to a core of plastics stretch film.

Referring to the drawings and particularly to FIGS. 1 and 3, a first embodiment of the apparatus for the application of plastics stretch film is seen at 10 in FIG. 1, a second embodiment of the apparatus for the application of plastics stretch film is seen at 30 in FIG. 3, and a third embodiment of the apparatus is seen at 70 in FIG. 6.

In FIG. 1 a roll of plastics stretch film 12 is shown on a core 14. An insertable adapter 20 is shown in FIG. 1 inserted in the core 14 (a similar insertable adapter 20 is also in the opposite end of the core 14).

A pair of cylindrical flexible, tube-like hand grips 16 are shown in FIG. 1 on the ends of said insertable adapter 20.

The inside diameter 18 of hand grips 16 is a close fit over the outside diameter of insertable adapter 20, but with sufficient clearance so that the insertable adapter 20 can turn easily within the hand grip 16.

Figure 2:
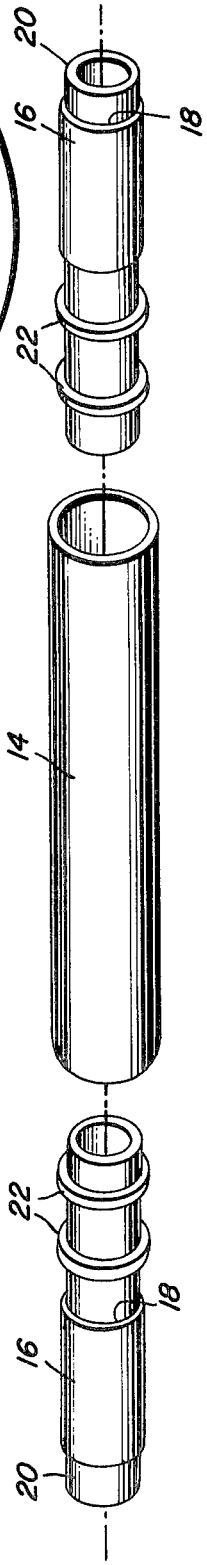
FIG. 2 is an exploded pictorial view of the first embodiment in FIG. 1.

In FIG. 2 the length of core 14 can be seen to be in one piece. The hand grips 16 are shown located on the insertable adapter 20, which in turn is shown in relation to the core 14. The inside diameter 18 of hand grip 16 is shown in relation to the outside diameter of the insertable adapter 20, and the outside diameter of the insertable adapter 20 is shown in relation to the inside diameter of the core 14.

In order to hold the insertable adapter 20 securely in place inside of the ends of core 14, a rubberized or other frictionable covering 22 is secured to the outside of the insertable portion of the insertable adapters 20. The rubberized or other frictionable covering 22 may be in liquid form and applied to the insertable adapter 20 and then dried, or a plurality of small strips of rubber-like or other frictionable material, as shown in FIG. 2, and held in place by a tight fit or by an adhesive, or as a single wide band applied similar to the aforementioned small strips, or any similar method of providing a rubberized or other non-slip surface, such as paper, plastic, ceramic or metallic fastening devices. All such variations are within the scope and intent of this invention.

The rubberized or other frictionable covering 22 holds the insertable adapter 20 securely in the core 14 so that when hand pressure is applied to the flexible hand grips 16, the braking action on the non-rubberized portion of the insertable adapter 20 controls the action without the insertable adapter 20 turning inside the core 14.

It is to be noted that the insertable adapter 20 may be tube-like, as shown in FIGS. 1 and 2, or may be solid or rod-like, such a variation is within the scope and intent of this invention.

Figure 5:
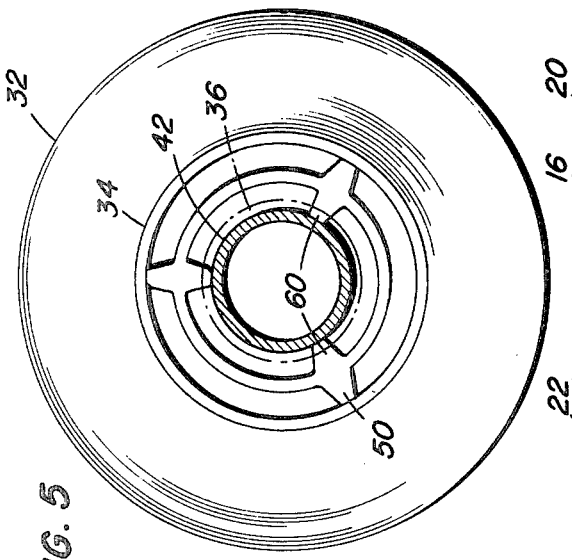
FIG. 5 is an end view of an insertable adapter showing a supply core and a control core.
Figure 4:
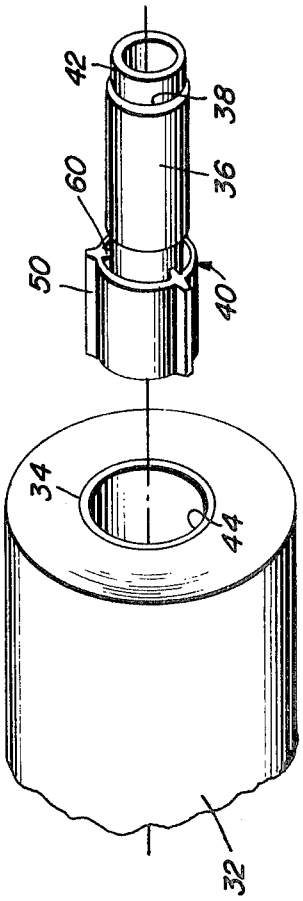
FIG. 4 is a partial exploded pictorial view of the second embodiment in FIG. 3.

Turning now to the second embodiment of the apparatus for plastics stretch film 30, the following description relates to FIGS. 3, 4 and 5.

The second embodiment of the apparatus for plastics stretch film 30 provides a means for using rolls of plastics stretch film 32 on core 34 where the length of the core 34 is approximately the same as the width of the roll of plastics stretch film 32, and the inside diameter of the core 34 is rather large in comparison to the aforementioned core 14. This second embodiment provides a means of using the roll of plastics stretch film 32 on a core 34 without the need for rerolling the plastics stretch film 32 off of a large diameter core such as core 34 on to a smaller diameter core such as core 14 in FIGS. 1 and 2.

As noted hereinbefore, the usual or normal outside diameter of core 34 is larger than the outside diameter of core 14 of the first embodiment.

Figure 7:
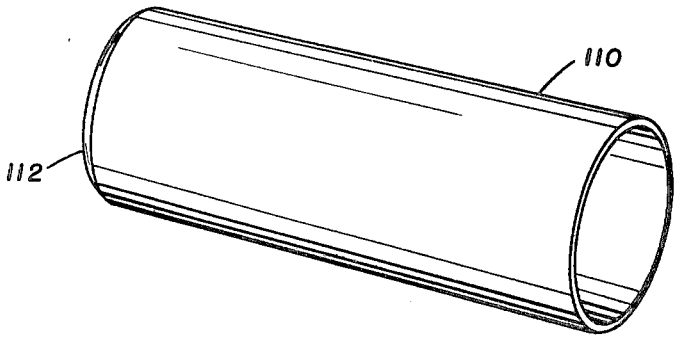
FIG. 7 is a pictorial view of a closed end hand grip for an insertable adapter for connection to a core of plastics stretch film.

The second embodiment provides a pair of enlarged insertable adapters 40 so that core 34 can be used with the same pair of hand grips 16 and the same pair of insertable adapters 20 that are used in the first embodiment. In FIGS. 3 and 4 the hand grips 16 of the first embodiment are shown as hand grips 36 for clarity when speaking of the second embodiment. Hand grips 16 of the first embodiment and hand grips 36 of the second embodiment are exactly alike and can be considered one and the same concept. Likewise, hand grip 72 of the third embodiment, described hereinafter, is also like hand grips 16 and 36. A variation in the hand grip is shown in FIG. 7. Hand grip 110 in FIG. 7 is closed at one end and may be used in place of hand grip 16, 36, or 72. The closed end 112 prevents the hand grip 110 from extending inward and rubbing the edges of the plastics film.

The aforementioned enlarged insertable adapter 40, is shown in FIGS. 3 and 4. It is also shown in FIG. 5 in greater detail.

It is to be noted that the large insertable adapter 40, one for each hand grip, may be constructed of any flexible rubberlike or other frictionable material including paper, plastic, ceramic or metallic materials or material with rubber-like characteristics.

The enlarged insertable adapter 40 is shown in FIG. 5 is cylindrical in configuration and hollow and can be seen having a plurality of exterior nodes 50 and a plurality of interior nodes 60. The hand grip 36 in FIG. 5 is shown in phantom encirclement of insertable adapter 42 so that the interfacing of internal node 60 with insertable adapter 42 can be shown.

The external nodes 50 and the internal nodes 60 are flexible and rubber-like so that as the enlarged insertable adapter 40 is pressed into the inside diameter 44 of core 34 as best shown in FIG. 4, the ends of the external nodes 50 compress as they interface with the inside surface 44 of core 34 and thus establish a tight friction fit. Three external nodes 50 are shown, however, it is to be understood that the plurality of external nodes 50 may be any number suitable for the requirement. Such variation is within the scope and intent of this invention.

In a like manner, the internal nodes 60 are also flexible and rubber-like and compress when the insertable adapter 42 is pressed into the inside diameter of the internal nodes 60 and thus establish a tight friction fit. Three internal nodes 60 are shown and it is to be understood that there may be any number of internal nodes 60 in the plurality and such variation is within the scope and intent of this invention.

Hand grips 36 are placed on the insertable adapter 42 the same as hand grips 16 were placed on the insertable adapter 20 in the first embodiment. The inside diameter 38 of hand grips 36 is a close fit over the outside diameter of insertable adapter 42, but with sufficient clearance so that the insertable adapter 42 can turn easily within the hand grip 36, the same as insertable adapter 20 of the first embodiment. The insertable adapter 20 and the insertable adapter 42 of the second embodiment are exactly alike and can be considered one and the same concept. It is to be noted that if the apparatus is used for machine application, the hand grips 16 and 36 would be in the form of brake shoes for the machine.

As to the materials: the cores 14 and 34 are usually of cardboard-like or fiber material, but could be any similar or suitable materials; the material of the insertable adapters 20 and 42 may be cardboard-like, fiber, plastics or any similar or suitable materials; the material for the hand grips 16 and 36 may be any flexible plastics, paper, leather, or fiber-like material, or any similar or suitable material, as long as the material will be flexible when squeezed. If a rigid material is used for the hand grips 16 and 36 with a slot cut through the length of the hand grip so that on end it appears to be a "C", such a variation is within the scope and intent of this invention. It is to be noted that the cutting of a slot in a rigid tube piece causes it to have some flexibility to be closed by gripping it and as such it is another version of this invention and is within the scope and intent of the present invention. However, the use of a rigid typed hand grip does not have the sensitivity that can be felt in the hand like that which is felt when the flexible hand grips 16 and 36 are used. The important factor here is that with a rigid type hand grip you have less sensitivity and control.

The third embodiment is a variation of the second embodiment for use in cores with large inside diameters.

Core 74 (FIG. 6) is similar to the core 34 in FIGS. 3, 4, and 5. The third embodiment of an insertable adapter 70 consists of a main body means 76, an expandable frictionable holder 78 and a clamping means 80.

The main body means 76 may be wood, plastics, or other suitable material and has a cylindrical hand grip shaft 82, a cylindrical core centering portion 84, a cylindrical connector portion 86, and a cylindrical core stop flange 88. The expandable frictionable holder 78 is a cylindrical and rubber-like, having a cylindrical inside passageway 90 therethrough, and an outside surface 92. The clamping means 80 consists of a dished end plate 94, a bolt 96 passing through an aperture in the center of said dished end plate 94 and having the head 98 welded at 100 to the dished end plate 94, a washer 102, and a wing nut 104.

The bolt 96 of the clamping means 80 is passed through the passageway 90 so that the dished end plate interfaces with the end of the rubber-like expandable holder 78. The bolt is then inserted in and through a passageway 106 through said main body means 76. A washer 102 and wing nut 104 completes the assembly. The inside passageway 90 fits over the cylindrical connector portion 86, and the core stop flange 88 interfaces with the end of the core 74 when the insertable adapter 70 is inserted in the core 74.

As the wing nut 104 is tightened on the bolt 96, the dished end plate 94 squeezes the expandable holder 78 against core centering portion 84 of the insertable adapter 70. This expands the outside surface 92 so that it interfaces with the inside surface of core 74 and the frictionable surface of the expandable holder 78 locks in place to the interior of core 74. Thus, with hand grips 72 on the hand grip shaft 82, the use and operation is the same as described for the second embodiment.

A variation of the bolt means, as shown in FIG. 6, may be made by welding a nut to the dished end plate 94 and using a bolt with a socket head to insert in a counterbore in the end of the hand grip shaft 82. Thus, the end of the hand grip shaft 82 is clear of any obstructions if a closed end hand grip 110 is used.

In operation, the user grips the hand grips 16 (for first embodiment) or 36 (for second embodiment) or 72 (for third embodiment) on the insertable adapters 20 and 42, respectively, and gives a slight squeeze to the hand grips 16 (or 36) in order to "feel" the insertable adapter 20 or 42. In the description of the operation which follows, only the first embodiment 10 will be described, the description for the second embodiment 30 is exactly the same.

The cases where the initial friction between the hand grips 16 or 36 and the insertable adapters 20 or 42, respectively, is too great to obtain a satisfactory "feel" or a free movement, a suitable lubricant, such as a light coating or powder or a wax may be used.

As the operator plays out the plastics stretch film 12 during the wrapping of a unit or the securing of unit to a transporting means, a sufficient grip is maintained on the hand grips 16 to provide the necessary control of tension on the plastics stretch film 12. This control of tension is gaged by the "feel" of the insertable adapter 20 through the soft flexible hand grips 16. The operator can make a full stop of the turning by a tight squeeze on hand grips 16 or the operator can have a free running play out of plastics stretch film 12 as the plastics stretch film unrolls by loosening the squeeze on hand grips 16. Varying of hand squeeze pressure on hand grips 16 permits the control of the play out of plastics stretch film 12 while also controlling how tightly the plastics stretch 12 is pulled to provide the wrap or securing of the unit being packaged or secured. The squeezing of the hand grips 16 provides a braking action that has controlled instantaneous results.

In the foregoing description the manual gripping of the flexible hand grips 16 and 36 has been described for purposes of explanation. It is to be understood that in a machine operation the gripping would be by mechanical means.

The use of this system may be practiced if a manufacturer winds the plastics stretch film on cores as illustrated in this invention, or by a user rewinding the film on a core of his choosing from a supply unit. It is to be noted that a single width of film may be wrapped on a core or two or more widths may be wrapped on the same core. This gives the user the option of using a narrow strip or a double wide strip or a plurality of strips without changing rolls for the job.

As can be readily understood from the foregoing description of the invention, the present structure and system can be configured or operated in different modes or ways to provide the ability to use plastics stretch film to package a unit or to secure a unit to a transporting means.

Accordingly, modifications and variations to which the invention is susceptible may be practiced without departing from the scope and intent of the appended claims.

What is claimed is:

1. An apparatus for applying plastics stretch films for packaging units, comprising:

a core for a roll of plastics stretch film said core consisting of a hollow cylindrical tube-like structure;

a pair of insertable adapters for extending said core, said insertable adapters being inserted in the opposite ends of said hollow cylindrical tube-like structure, each said adapter consisting of a cylindrical core having a portion of the external surface of one end of each said cylindrical core covered with a rubber-like material, the end of each said cylindrical core having a portion covered with rubber-like material removably affixed to the inside diameter of said core; and a pair of flexible hand grips removably encircled about said insertable adapters for control of the tension on plastics stretch film on said core while unrolling during manual applications for packaging.

2. The apparatus for applying plastics stretch film for packaging units as recited in claim 1, wherein said insertable adapters are hollow tube-like structures.

3. The apparatus for applying plastics stretch film for packaging units as recited in claim 1, wherein said insertable adapters are rod-like structures.

4. The apparatus for applying plastics stretch film for packaging units as recited in claim 1, wherein said rubber-like material is a liquid-type coating cured in place.

5. The apparatus for applying plastics stretch film for packaging units as recited in claim 1 wherein said rubber-like material is at least one rubber-like band secured to the external surface of one end of said cylindrical core.

6. The apparatus for applying plastics stretch film for packaging units as recited in claim 1, wherein said flexible hand grips have an inside diameter substantially the same as the outside diameter of said insertable adapters so that the inside surface of each said flexible hand grips slidingly interfaces with the outside surface of said insertable adapter.

7. The apparatus for applying plastics stretch film for packaging units as recited in claim 1, and additionally, an enlarged second pair of insertable adapters, said enlarged insertable adapters each consisting of hollow cylindrical tube-like structure having a plurality of external nodes and a plurality of internal nodes, said second pair of enlarged insertable adapters being first removably inserted into each end of said cylindrical core when the inside diameter of said core is larger then the exterior diameter of said end of cylindrical core having a portion covered with rubber-like material, said plurality of external nodes interfacing with the internal diameter of said core in a friction fit, said first pair of insertable adapters then being removably affixed to the inside of said cylindrical core by removably inserting said first pair of insertable adapters into the interior of said second pair of insertable adapters so that said end of said cylindrical core having a portion covered with rubber-like material interfaces with said internal nodes of enlarged insertable adapter in a friction fit.

8. The apparatus for applying plastics stretch film for packaging units as recited in claim 7, wherein said external and internal nodes are flexible rubber-like material.

9. The apparatus for applying plastics stretch film for packaging units as recited in claim 6, wherein said flexible hand grips are open at each end.

10. The apparatus for applying plastics stretch film for packaging units as recited in claim 6, wherein said flexible hand grips are closed at one end.

11. The apparatus for applying plastics stretch film for packaging units as recited in claim 1, wherein said cylindrical core of said first pair of insertable adapters is a solid material, said cylindrical core being configured as four concentric cylindrical portions of different diameters, a first diameter to receive said covering of rubber-like material, second diameter removably inserted in said core for said roll of plastics stretch film, a third diameter having one face of which interfaces with an end of said core for said roll of plastics stretch film, and a fourth diameter to receive said pair of flexible hand grips, said solid cylindrical core having a passageway longitudinally therethrough.

12. The apparatus for applying plastics stretch film for packaging units as recited in claim 11, and additionally a clamping means, said covering of rubber-like material being hollow cylindrical core-like means, said hollow cylindrical core-like means having an outside surface and an inside surface and having two ends spaced apart, said first diameter of said cylindrical core being removably inserted in said covering of rubber-like material, whereby said inside surface thereof interfaces with the surface of said first diameter, said covering of rubber-like material being affixed to said cylindrical core by said clamping means, said affixing of said insertable adapters to said inside diameter of said core for a roll of plastics stretch film being accomplished by operation of said clamping means, with said hollow cylindrical core-like means being expanded by said clamping means when tightened to cause a tight interface of said outside surface of said hollow cylindrical core-like means with said inside diameter of said core for a roll of plastics stretch film.

* * * * *